United States Patent [19]

Sexstone

[11] 3,943,832

[45] Mar. 16, 1976

[54] METHOD AND APPARATUS FOR THE HANDLING OF TOW IN THE MANUFACTURE OF TOBACCO SMOKE FILTERS CONTAINING PARTICULATE MATERIAL

[75] Inventor: John H. Sexstone, Middletown, Ky.

[73] Assignee: Brown & Williamson Tobacco Corporation, Louisville, Ky.

[22] Filed: Mar. 13, 1974

[21] Appl. No.: 450,574

[52] U.S. Cl. ..... 93/1 C; 93/77 FT; 131/265

[51] Int. Cl.[2] ..... A24C 5/50

[58] Field of Search ..... 93/1 C, 77 FT; 131/261 R, 131/261 B, 265; 156/180

[56] References Cited

UNITED STATES PATENTS

| | | | |
|---|---|---|---|
| 1,410,745 | 3/1922 | Gates | 93/1 C |
| 2,423,554 | 7/1947 | Davidson | 93/1 C |
| 2,793,572 | 5/1957 | Parmele | 93/1 C |
| 3,128,680 | 4/1964 | Schaaf, Jr. | 131/265 X |
| 3,693,313 | 9/1972 | Sexstone | 93/1 C X |
| 3,837,264 | 9/1974 | Sexstone | 93/1 C |
| 3,844,200 | 10/1974 | Sexstone | 93/1 C |

OTHER PUBLICATIONS

Def. Pub. T860013, Mar. 25, 1969, Hawkins et al.

*Primary Examiner*—James F. Coan

*Attorney, Agent, or Firm*—Finnegan, Henderson, Farabow & Garrett

[57] ABSTRACT

A method and apparatus for the handling of tow in the manufacture of filter rods containing particulate material. The process is characterized by feeding a continuous web of filter material, folding the edges of the web beneath the center portion of the web, and forming the shaped web into a longitudinally extending channel with the edges of the web beneath the base of the channel. The web so formed is then processed into a filter rod by depositing particulate material into the channel at axially spaced positions and gathering the web and particulate material into a filter rod with the particulate material forming a center core. The apparatus disclosed includes means for feeding a continuous web of filter material, aperture defining means in the path of the web for receiving the web through said aperture and folding the web edges beneath the center portion of the web, means in the path of the web feed for forming the folded web into a channel. The apparatus also includes filter rod forming means comprised of means for depositing particulate material into the channel at axially spaced positions and means for gathering the web and particulate material into a filter rod.

17 Claims, 7 Drawing Figures

5.
40
16
38
46
18
50
44
6.
54
48
60
66
62
7
58
74
70
24
30
68
52
42
92
90

METHOD AND APPARATUS FOR THE HANDLING OF TOW IN THE MANUFACTURE OF TOBACCO SMOKE FILTERS CONTAINING PARTICULATE MATERIAL

BACKGROUND OF THE INVENTION

1. Field of the Invention

This invention relates to a method and apparatus for the manufacture of filter plugs for use in cigarettes and like articles.

More particularly, this invention relates to a method and apparatus for the manufacture of such filter plugs from a web of material, such as cellulose acetate, with particulate material deposited on said web and gathered with said web to form the filter plug.

Specifically, the invention relates to a method and apparatus for the handling of tow to provide for a channel of web material into which particulate material can be deposited at spaced positions axially thereof to accurately control the location of the particulate material in each filter plug ultimately cut from the formed filter rod.

2. Description of the Prior Art

Throughout the last decade, the tobacco industry has focused considerable attention on providing high quality filtering components having a zone, region or part thereof comprised of loose particulate or granular material. Typically, this material lies between sections of filtering material such as cellulose acetate, or paper, which have been gathered into a conventional plug form with the particulate material circumferentially bounded by a plug wrapper.

In other instances it has been deemed desirable to position the particulate material within or throughout other filtering material such as cellulose acetate. In regard to the latter, particulate material is typically provided at spaced positions along a web of filter material such as cellulose acetate and the web and particulate material are then gathered into a filter rod by garniture assemblies.

Numerous difficulties, however, have developed in attempting to place particulate material accurately on a web being fed through a high speed filter forming machine and in maintaining the particulate material in a desired position as it is being gathered into a filter rod.

If the particulate material within a filter plug is to achieve its desired end, that of filtering the smoke, the smoke must flow through the minute spaces between the particles of the material so that the surfaces of the particles are exposed to the smoke. Moreover, it is critical that a reasonable degree of consistency be provided as the filtering capability of the cigarettes so that the taste and pressure drop does not vary widely among cigarettes of the same brand.

Accordingly, it is a primary object of this invention to provide a new and improved method and apparatus for forming filters containing particulate material which will alleviate the aforementioned difficulties in the art.

It is also a primary object of this invention to provide such a new and improved method and apparatus that may be utilized commercially in relation to high speed cigarette making operations in an inexpensive and efficient manner.

A further object of this invention is to provide such a method and apparatus which will produce a high quality filter plug having the desired characteristics for properly filtering the smoke and being of a shape and character that is acceptable to provide a high quality smoking article.

It is another object of this invention to provide such a method and apparatus wherein the ultimate disposition of the particulate material within the filter plug can be accurately controlled to provide consistency of filtering and smoking characteristics.

It is also an object of this invention to provide a method and apparatus which minimizes the loss of particulate material during processing, thus minimizing housekeeping problems.

Additional objects and advantages of the invention will be set forth in part in the description which follows and in part will be obvious from the description, or may be learned by practice of the invention. The object and advantages of the invention may be realized and obtained by means of the instrumentalities and combinations particularly pointed out in the appended claims.

Summary of the Invention

To achieve the foregoing objects, and in accordance with the purposes of this invention as embodied and broadly described herein, the method of this invention comprises the steps of feeding a continuous web of filter material having opposed edges, shaping the web to provide web portions in first and second planes, said first plane overlying said second plane, said opposed edges being positioned in said second plane and forming the shaped web into a channel with the opposed edges at the base thereof.

To also achieve the foregoing objects and in accordance with the purpose of this invention as embodied and broadly described herein, the apparatus of this invention comprises means for feeding a continuous web of filter material, means in the path of said feed for folding edges of the web into a plane beneath the plane of the center portion of said web and means in the path of said feed for forming the folded web into a channel.

BRIEF DESCRIPTION OF THE DRAWINGS

The invention consists of the novel parts, constructions, arrangements, combinations, and improvements shown and described. The accompanying drawings which are incorporated in and constitute a part of the specification illustrate one embodiment of the invention, and together with the description, serve to explain the principles of the invention.

DESCRIPTION OF THE PREFERRED EMBODIMENTS

Figure 1:
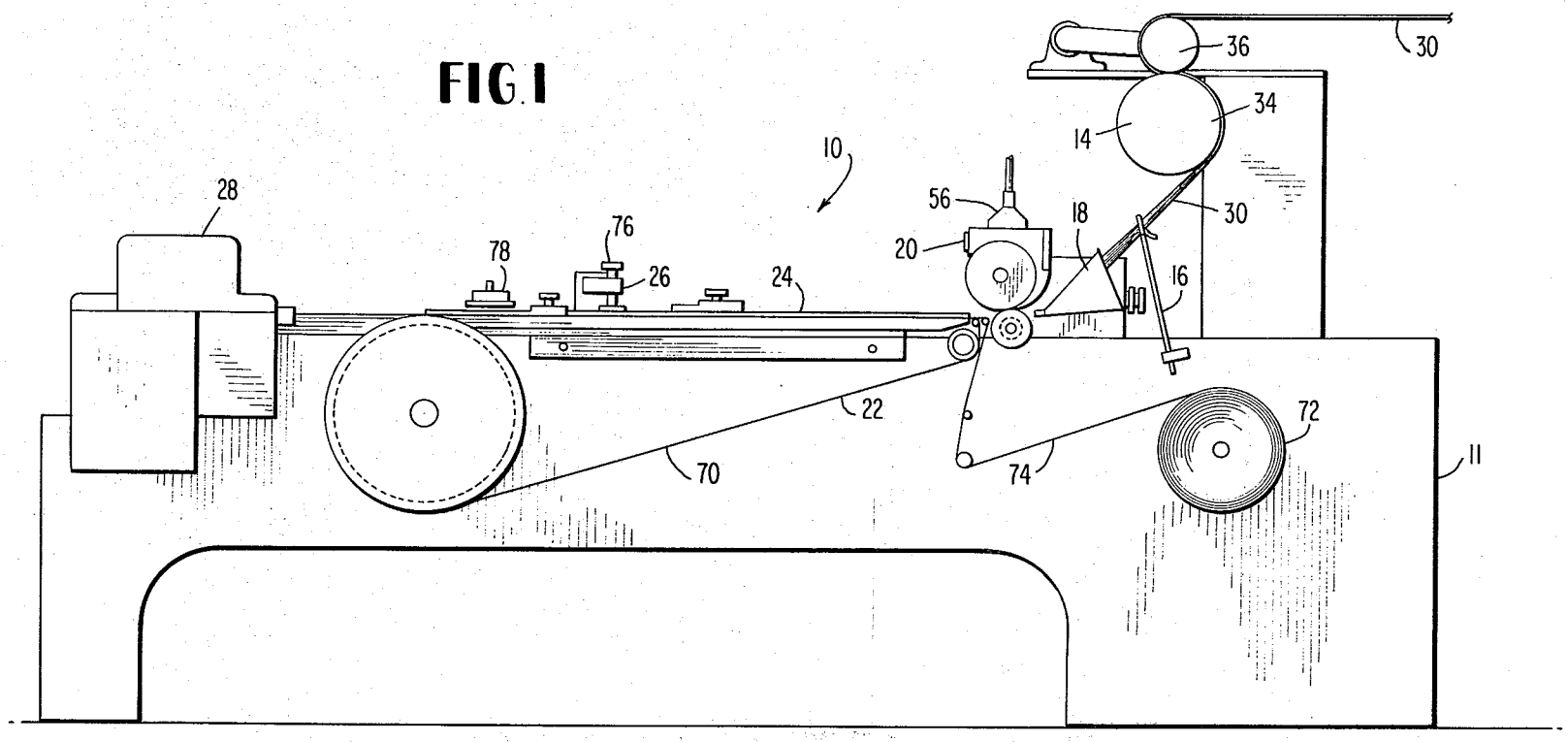
FIG. 1 is a side elevational view of the apparatus of this invention.

Referring to FIG. 1, an apparatus 10 is illustrated including a frame 11 having operatively mounted thereon, a web feeding assembly 14, a guide 16, a trumpet 18, particulate material deposition assembly 20, conveying tape assembly 22, garniture 24, wrapper sealing assembly 26, and a filter plug cutting assembly 28. The web 30 described and illustrated in relation to this invention is comprised of a fibrous cellulose acetate. Filter materials such as paper, bulk yarn, other filamentary tow or any other suitable material may be utilized.

The material to be deposited on the web must have the desired absorbative and adsorbative properties, and be either in particulate or granular form. The particulate material may be finely divided charcoal, silica gel, volcanic salts, ion exchange resins, clays and the like. A particular additive contemplated by this invention is the ion exchange resin "DUOLITE" which may be of the type disclosed in commonly assigned U.S. Pat. No. 3,716,500 granted July 13, 1973.

In the illustrated embodiment, the web 30 is initially subjected to a web treating assembly, not illustrated, which includes a tow opening unit for spreading or blooming the tow in a manner well known to the art, and a conventional plasticizer applicator. The plasticizer typically utilized for cellulose acetate tow is triacetin.

The web 30 so treated is fed by assembly 14 comprised of a delivery roll 34 and roller 36 to guide 16 where manipulation of the tow to achieve the desired result of this invention is initiated.

In accordance with the invention, means are provided in the path of web 30 for folding the edges of the web into a plane beneath the plane of the center portion of the web. Preferably this is accomplished by guide means 16. The guide 16, illustrated in FIGS. 1 and 5, includes a shaft portion 38 for mounting to the frame 11, and an aperture forming portion 40 at the end of shaft portion 38.

The portion 40 defines an aperture having a width normal to the axis of the web 30 of lesser dimension than the transverse dimension of the web. As illustrated, the aperture is defined by arcuately shaped surfaces 42. The surfaces 42 cause the edges of the web to fold inwardly beneath the center portion of the web 30.

Figures 4, 5, 6, 7:
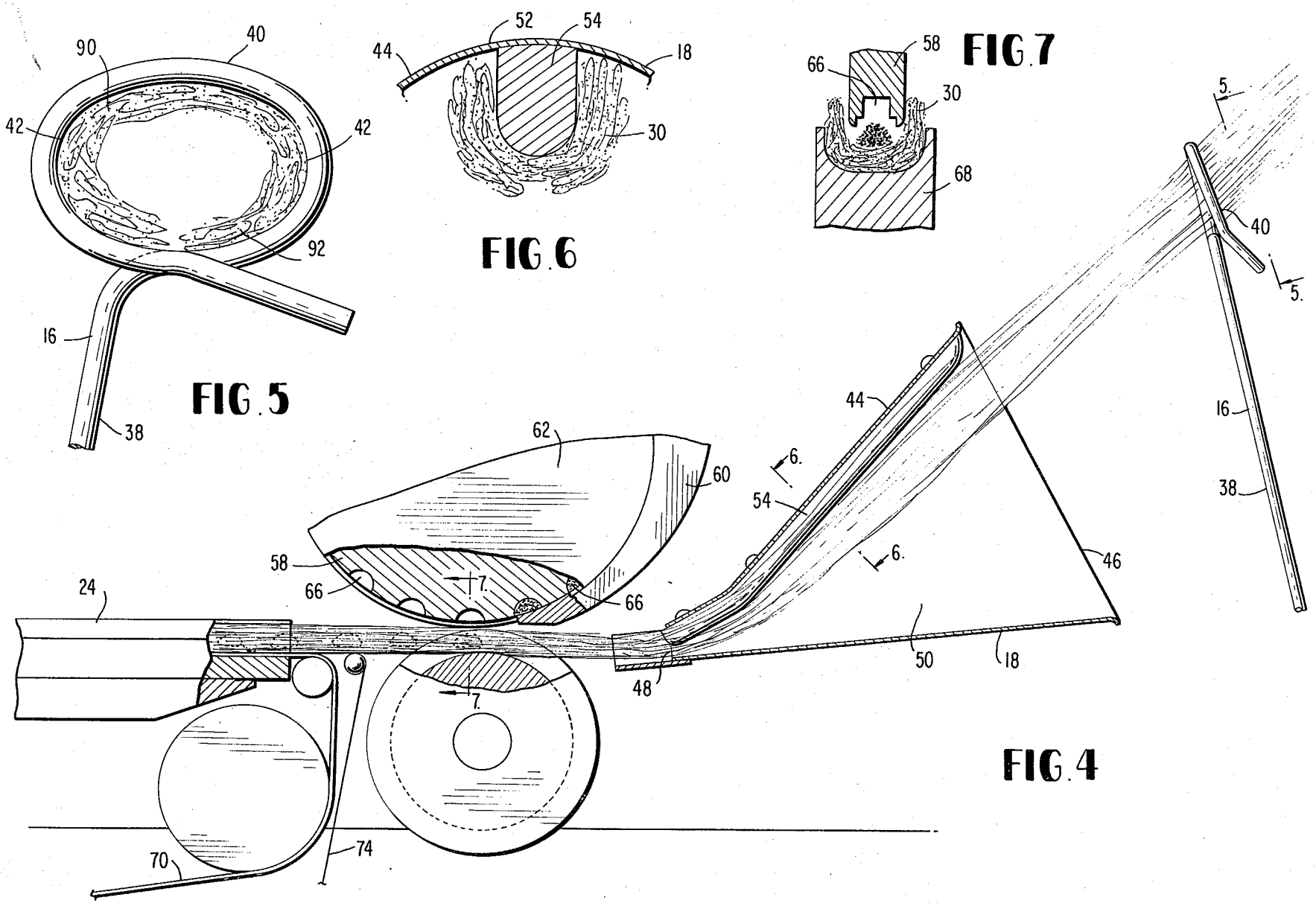
FIG. 4 is a side elevational view of a portion of the apparatus illustrated in FIG. 1 showing the web being fed through a guide, a trumpet and beneath a deposition wheel where particulate material is deposited into a channel shaped web.
FIG. 5 is a sectional view of a web taken along lines 5—5 of FIG. 4 showing the web as it passes through the guide.
FIG. 6 is a sectional view taken along lines 6—6 of FIG. 4 showing the web as it passes through the trumpet and is formed into a channel about a rib in the trumpet.
FIG. 7 is a sectional view of the web after it has passed beneath the deposition wheel showing the web in a channel shape with a deposit of particulate material therein.

Once the tow is placed within the guide 40 it will continue to feed from delivery roll 34 in a manner which converts the flat web into the folded configuration as illustrated in FIG. 5. In this configuration, the edges of the tow are folded inwardly beneath the center portion of the tow, as illustrated in FIG. 5. The aperture defined through the guide portion 40 may take various shapes; however, it is deemed preferable that the aperture be rounded, for instance, a circular or eliptical form. In this manner, the web does not bind as it is fed through the guide 16.

In accordance with the invention, means are provided in the path of feed of web 30 for forming the folded web into a channel. Preferably this channel forming means is comprised of trumpet 18. Trumpet 18 includes a housing 44 having opposed receiving and exit openings 46 and 48 respectively communicating with a through chamber 50. The upper sidewall 52 of the trumpet 18 contains a rib member 54 extending in the illustrated embodiment from the receiving opening 46 to the exit opening 48. As shown in FIG. 6, rib member 54 projects inwardly of chamber 50 for engaging web 30 centrally thereof, causing web 30 to form a generally U-shaped cross-sectional configuration.

The formation of web 30 into a channel member with the edges of web 30 disposed beneath the base of the channel provides a significantly more stable web structure. Particulate material may be placed in deposits on this structure and moved through a garniture for folding the sidewalls of the channel over the particulate deposits in such a manner that the deposits stay in place until appropriately secured by the folded web. The combination of the guide 16 and the trumpet 18 consistently provide for the formation of the web into such a channel with the edges of the web positioned beneath the base of the channel to produce a consistency of filter plug construction heretofore unknown to the art.

In accordance with this invention, means for depositing particulate material into the channel so formed by the guide 16 and trumpet 18 is provided by the deposition assembly 20. The assembly 20 includes a hopper 56, a deposition wheel 58, a retaining shoe 60 and a wheel casing 62. The deposition wheel 58 includes a plurality of recesses 66 in its outer rim which, upon rotation receive material from hopper 56 by gravity feed. The wheel 58 is then rotated through approximately 180°, where, as shown in FIG. 4, the particulate material is deposited in the channel-shaped web 30. The material is retained in the recesses 66 during rotation by means of the retaining shoe 60.

The web 30 upon leaving the exit opening in a channel-shaped configuration is received between a grooved roller 68, having a channel-shaped groove 70 formed in its rim, and the deposition wheel 58. The grooved roller 68 assists in retaining the channel shape of web 30.

The deposition wheel 58 is driven in a conventional manner at a speed in relation to the speed of conveyance of the channel-shaped web 30. The relative speeds of the two, determining the spacing between the deposits of particulate material.

In accordance with the invention, means are provided for gathering the web and particulate material into a filter rod with the particulate material forming the center core. This gathering means is illustrated herein as garniture 24. Garniture 24 is a conventional barrel-type folder which, over its length, folds or rolls the sidewalls of the channel-shaped web 30 into overlying relation to the particulate material deposits or, in the areas where there were no deposits it simply folds the web material together into a conventional plug section.

At the point where the channel-shaped web passes beneath the deposition wheel 58, a filter wrapper 74 is fed between the web 30 and the conveying tape 70 from a reel 72. The wrapper 74 is formed about the web material in a conventional manner, and is sealed in assembly 26.

The assembly 26 includes an adhesive applicator 76 and a heater 78. The adhesive applicator applies a strip of adhesive to one edge of the wrapper 74, which is then moved into overlying relation to the other edge of the wrapper to adhere said edges together in an overlapping joint. The adhesive is then heat-set by the heater 78 before the filter rod is conveyed to the filter plug cutting assembly 28.

Figure 2:
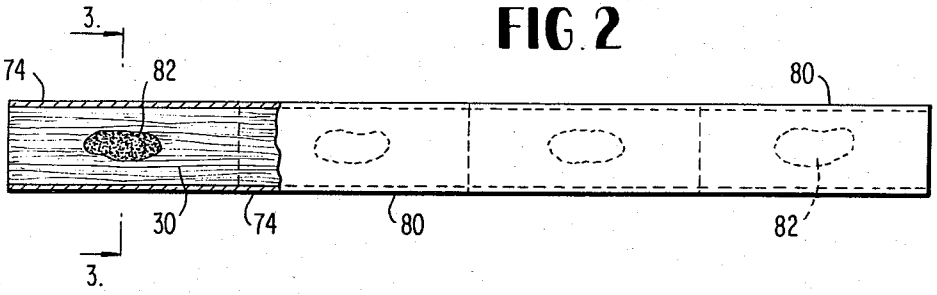
FIG. 2 is a plan view of a segment of a filter rod produced by the apparatus of FIG. 1 having a portion broken away to show the plug wrapper, filtering material and a center core of particulate material. The transverse-lines designate the points at which the rod is cut to form the individual filter plugs.

In the cutting assembly 28, the formed filter rod is cut into individual filter plugs, in a conventional fashion. Referring to FIG. 2, the filter rod is cut along the transverse dash lines of FIG. 2 to provide individual filter plugs 80, each having a wrapper 74 disposed about its periphery, and containing therein, filter material 30, in this instance cellulose acetate, and a core of particulate material 82. Because of the construction of the web 30 in the particular channel-shaped configuration formed by the described apparatus, the individual deposits of particulate material are retained accurately in position in the center of each of the individual plugs 80. This avoids any migration of the particulate material through the plug 80, and particularly prevents such migration from extending to the edges of the plug 80 where the particulate material might contact the mouth of the ultimate user of the filter.

In accordance with this invention, the method of manufacturing tobacco-smoke filters having particulate material therein commences with the feeding of a continuous web 30 of filter material disclosed herein as cellulose acetate. As previously discussed, however, other web materials may be utilized. The feeding of the web may occur continuously or intermittently, depending upon the nature of the operation desired.

In accordance with this invention, the method then includes the step of forming the web 30 into a channel having the opposed edges of the web 30 at the base of the channel.

Preferably, the channel is formed such that the opposed edges of the web lie at the outer surface of the channel beneath the base of the channel. In this manner, the sidewalls of the channel, as illustrated in FIG. 7 are comprised of numerous plys being joined by a plurality of bends or folds at the upper edge of said sidewalls providing an extremely stable, channel-shaped configuration for receiving the particulate material, and retaining the material in place until the sidewalls are folded and secured about the particulate material.

In accordance with this invention, the channel previously described is achieved by first shaping the web 30 to provide web portions 90 and 92 in first and second planes, said first plane overlying said second plane, with the edges of the web 30 being positioned in the second plane.

Preferably the flat web 30 is shaped into the configuration of FIG. 5 by folding the edges of web 30 beneath the center portion 90 of web 30. This folding is achieved by moving the web 30 through the aperture in guide 16 which has a lesser transverse dimension than web 30. This forces the opposed edges of the web inwardly beneath the center portion 90 and into the second plane. The result is a web 30 having a generally rounded cross-sectional shape with a hollow interior.

After passing through the guide 16, web 30 is directed through trumpet 18 in such a manner that the portion 90 of the web 30 is impressed by rib member 54 to force that portion downwardly to define the base of the channel as illustrated in FIG. 6. This moves the center of the web or portion 90 which was previously located in the first plane into contacting relation with the web portion 92. Thus web portion 90 generally forms the interior surface of the channel with web portion 92 forming the exterior surface of the channel.

In accordance with this invention, the process then includes the step of depositing particulate material into the formed channel at axially spaced positions. Referring to FIG. 4, this step occurs by passing the web 30 beneath the deposition wheel 58 which transfers particulate material via recesses 66 from the hopper 56 into the channel-shaped web 30. If an intermittently fed web is utilized, other types of deposition mechanisms would be employed for accomplishing this step of the method.

In accordance with this invention, the web is then gathered with the particulate material into a filter rod, with the particulate material forming a center core. This is accomplished in the illustrated embodiment by passing the web of particulate material into the garniture 24. The garniture 24 gradually, as the web passes through, folds the sidewalls of the channel over the particulate material, or in the instance where no particulate material exists, as between the deposits, into a type of overlapping relation to provide the cylindrical filter plug.

Figure 3:
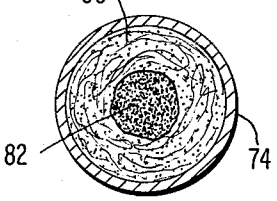
FIG. 3 is a sectional view taken on line 3—3 of FIG. 2 showing the construction of the filter plug formed by this invention.

At this point, the wrapper 74 is joined with the web 30 and is wrapped about the web 30 for sealing in assembly 26. In a conventional fashion, adhesive is applied to the wrapper 74 by an applicator 76 and is heat-set by heater 78 to provide a finished filter rod. The rod is then passed to cutter assembly 58 where it is cut in conventional fashion into individual filter plugs of the nature of those illustrated in FIGS. 2 and 3.

It will be apparent to those skilled in the art that various modifications and variations could be made in the method and apparatus constituting this invention without departure from the scope or the spirit of the invention.

What is claimed is:

1. A method for handling a tow of web material in the manufacturing of tobacco smoke filters having particulate material therein comprising:

a. feeding a continuous web of filter material having opposed edges;

b. shaping the web to provide web portions in first and second planes, said first plane overlying said second plane, said opposed edges being positioned in said second plane; and c. forming the shaped web into a channel with the opposed edges at the base on the opposite side from the trough of said channel thereof.

2. A method as recited in claim 1 wherein said channel is formed by moving the center of said web portion in the first plane into contacting relation with the web portion in the second plane.

3. A method as recited in claim 1 wherein said web is shaped by folding the edges of said web beneath the center portion of said web.

4. A method is recited in claim 1 wherein the web is shaped by moving said web through an aperture of a lesser transverse dimension than said web causing the edges of said web to fold into said second plane forming a tow of generally tubular shape.

5. A method as recited in claim 4 wherein said aperture has rounded edges forming said web into a rounded cross-sectional shape with a hollow interior.

6. A method as recited in claim 1 further including the steps of depositing particulate material into said channel at axially spaced positions and gathering said web and particulate material into a filter rod with the particulate material forming a center core at spaced positions in said core.

7. A method as recited in claim 1 wherein the sidewalls and base of said channel are comprised of substantially equal thicknesses of filter material.

8. A method as recited in claim 1 wherein the gathering into a filter rod occurs by folding the sidewalls of the channel shaped web over the deposit.

9. A method of manufacturing tobacco smoke filters having particulate material therein comprising:

a. feeding a continuous web of filter material having opposed edges;

b. forming said web into a channel having the opposed edges of said web at the base of said channel on the opposite side from the trough of said channel;

c. depositing particulate material into said channel at axially spaced positions; and d. gathering said web and particulate material into a filter rod with the particulate material forming a center core.

10. A method as recited in claim 7 wherein the channel-shaped web is formed by folding a flat web, such that the edges underlie the center portion of the web and moving the center portion of said web downwardly to form the base of the channel.

11. A method as recited in claim 10 wherein the folded web defines a hollow interior and is generally rounded.

12. An apparatus for handling a tow of web material in the manufacturing of tobacco smoke filters comprising:

a. means for feeding a continuous web of filter material;

b. means in the path of feed of said feeding means for folding edges of the web into a plane beneath the plane of the center portion of said web; and c. means in the path of feed of said feeding means for forming the folded web into a channel.

13. The apparatus of claim 12 wherein the folding means is comprised of a guide having means defining an aperture through which the web passes, said aperture having a width normal to the axis of the web of lesser dimension than the transverse dimension of the web.

14. The apparatus of claim 13 wherein the aperture defining means defines a rounded aperture.

15. The apparatus of claim 12 wherein the channel forming means comprises a housing for receiving the tow, said housing having opposed openings through which the web passes, said web bearing against one interior surface of said housing and a rib member extending along said surface and projecting inwardly therefrom to engage the web centrally thereof and cause the web to form a U-shaped configuration.

16. The apparatus of claim 15 wherein the housing is trumpet shaped having a large web receiving opening and a small web exit opening.

17. The apparatus of claim 13 further including means for depositing particulate material into the channel formed by said web at axially spaced positions and means for gathering the web and particulate material into a filter rod with the particulate material forming a center core.

* * * * *